US006056672A

United States Patent [19]

Carbonell Tendero

[11] Patent Number: 6,056,672

[45] Date of Patent: May 2, 2000

[54] TRAINING APPARATUS FOR CYCLIST AND FOR PHYSICAL EXERCISE

[76] Inventor: D. Juan Jose Carbonell Tendero, c/Mariano Amigo no. 11, Puzol, Spain, 46530

[21] Appl. No.: 08/914,818

[22] Filed: Aug. 20, 1997

[30] Foreign Application Priority Data

Aug. 20, 1996 [ES] Spain ..... 96.02.232

[51] Int. Cl.[7] ..... A63B 22/06

[52] U.S. Cl. ..... 482/57; 482/61; 434/61; 434/67; D21/664

[58] Field of Search ..... 482/57, 61, 902; 434/61, 67; D21/663, 664

[56] References Cited

U.S. PATENT DOCUMENTS

| | | | |
|---|---|---|---|
| 2,498,047 | 2/1950 | Myers | 601/93 |
| 2,803,349 | 8/1957 | Talbot | 261/17 |
| 4,082,265 | 4/1978 | Berkes | 272/73 |
| 4,415,152 | 11/1983 | Smith | 272/73 |
| 5,662,559 | 9/1997 | Vasquez | 482/61 |

*Primary Examiner*—Richard J. Apley
*Assistant Examiner*—Tam M. Nguyen
*Attorney, Agent, or Firm*—Jacobson, Price, Holman & Stern, PLLC

[57] ABSTRACT

The invention provides an apparatus for the training of cyclists that simulates the riding of a bicycle while in a stationary position. The training apparatus includes a running belt in a platform base on top of which are placed the wheels of a bicycle and a front vertical bar that secures the bicycle at the frame or handlebars onto the apparatus. The front vertical bar is adapted to pivotally swing laterally back and forth so that a rider of the bicycle may exert a force thereby tilting the bicycle to facilitate pedaling, and springs attached to the front vertical bar provide resistance against the inclination and return the bicycle to a generally vertical orientation. Stops are also provided to limit the degree of inclination of the bicycle.

11 Claims, 2 Drawing Sheets

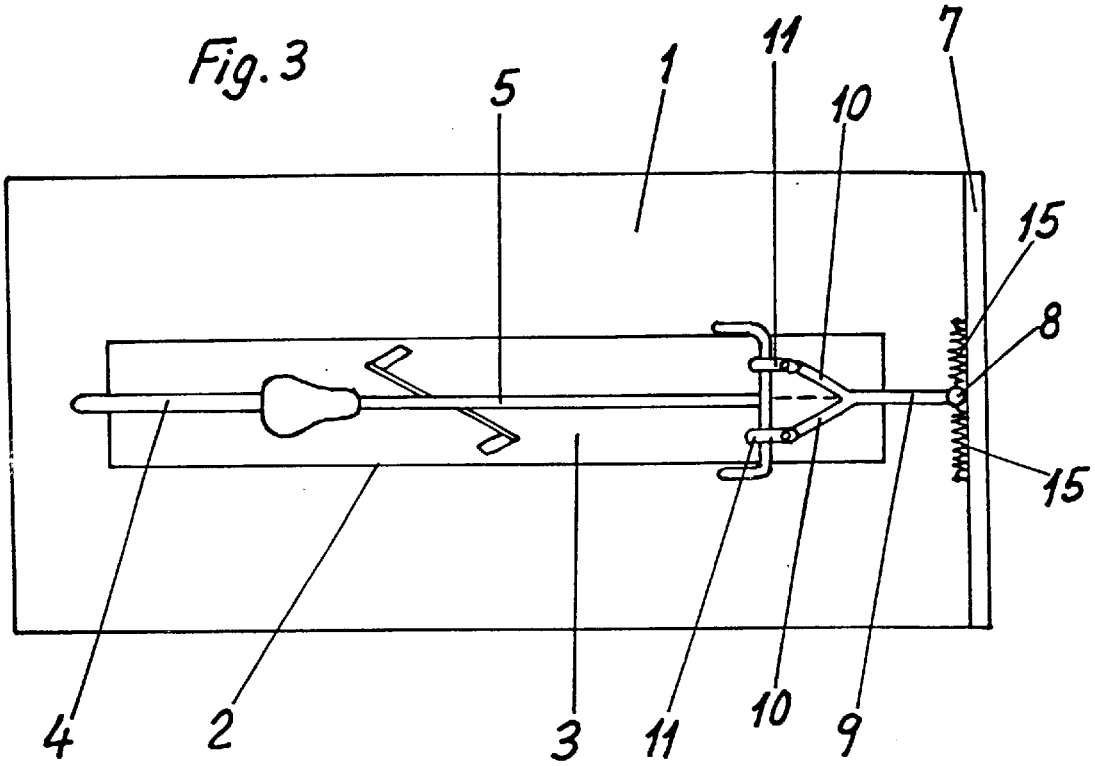
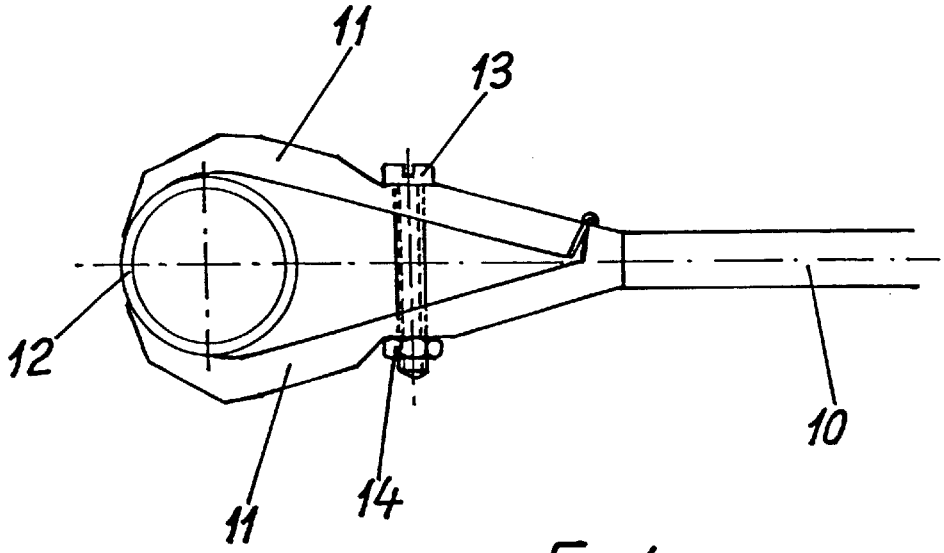
Fig. 4

TRAINING APPARATUS FOR CYCLIST AND FOR PHYSICAL EXERCISE

BACKGROUND OF THE INVENTION

The present invention is a new and useful device for cyclist training and fine-tuning, or simply for exercise and keeping fit, contributing unquestionable advantages and improvements which will make the unit of the greatest use to its users, having structural and design characteristics which differ significantly from all the elements and mechanisms for these purposes which are known at present.

SUMMARY OF THE INVENTION

In general, the cyclist training apparatus which is the subject of this application consists of a rectangular base which is divided into three parts, two for supporting the feet and the third as a central area along which a continuous loop conveyor belt runs on which the bicycle is installed and secured using standard methods. It also has two handrails or bannisters for the cyclist's safety, up to a suitable height on the sides of the base; in the front of the unit, there is a vertical front plate with a raised arm with devices by which to attach the bicycle by the frame or handlebars.

The mechanical operation of this apparatus is as follows:

The cyclist or user mounts the standard bicycle on the belt and attaches it at the handlebar. This locks the steering and results that the bicycle will always run along the center of the belt. The bicycle also remains upright, so that the cyclist can mount in complete safety.

This training device has a special feature in that the support allows the cyclist to lean the bicycle so as to reproduce the characteristic movements involved in standing on the bicycle so that it can oscillate sideways while the wheels remain in line and in the centre of the support belt. This movement is provided by a system whereby an arm holding the bicycle is secured to a vertical support or bar on the floor, moored at the mid point of the front of the base, to give a pendular upward movement.

This support which allows the bicycle to lean or tilt has two small suspension or similar systems using springs or road-springs which are designed to maintain the support and retain the bicycle in the vertical position, so that the bicycle is forced to tilt by the cyclist, thus facilitating pedalling whenever required. This support also has stops in the base to prevent an inclination of more than 20° from the vertical in either direction.

The support securing the bicycle is adjustable so that the suspension systems controlling said support exert more or less force along the axis, to make it easier or harder to tilt the bicycle.

For a better understanding of the general characteristics set out, drawings are attached with a graphic and diagrammatic representation of one practical design for the cyclist training device referred to here, and it is recorded that, because of the eminently informative nature of the drawings in question, the figures they contain must be considered with the very broadest criteria and without any limitation whatsoever.

BRIEF DESCRIPTION OF THE DRAWINGS

The figures in the attached drawings show:

FIG. 3.—A lengthwise ground plan projection of the apparatus showing the arrangement and assembly of the bicycle on the moving belt in the center of the training apparatus and its attachment to the bicycle frame or handlebar, by means of a swivel support of limited inclination.

FIG. 4.—A side view of one of the connections forming part of the apparatus, forming a type of flange with a tightening bolt, to provide a simple, quick and safe connection for the bicycle on to the apparatus.

DESCRIPTION OF THE PREFERRED EMBODIMENT

Figure 1:
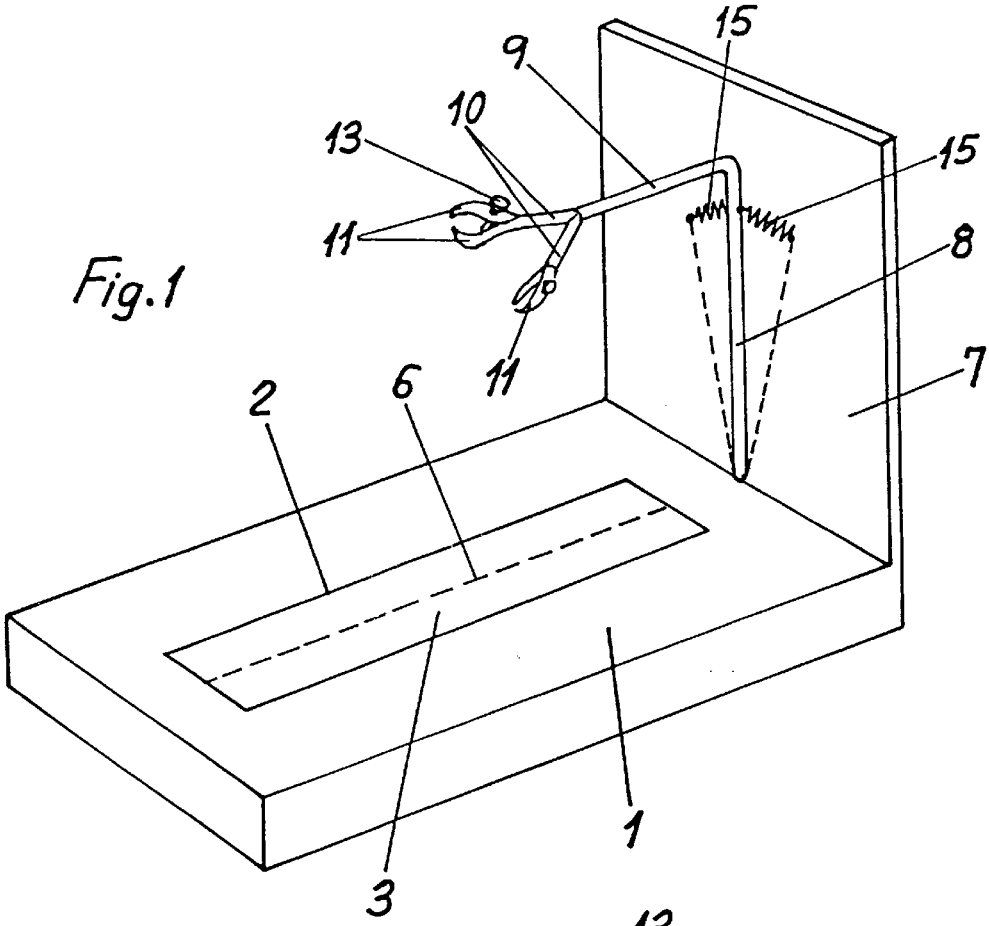
FIG. 1.—A standard perspective projection of this apparatus showing, in the centre of the base, the moving belt on which the bicycle runs, with the attachment connection at the top of the front panel, in elevation, and with the vertical panel itself showing the oscillation of the connection support.
Figure 2:
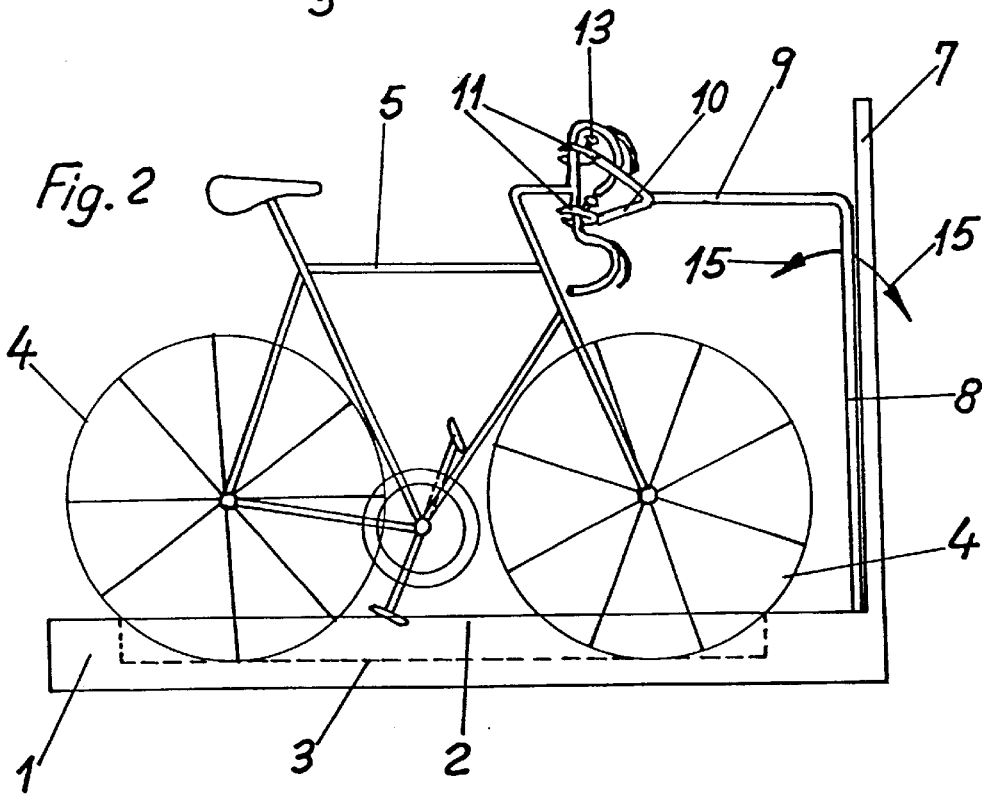
FIG. 2.—A side elevation of the apparatus with a bicycle set up on it, showing the points at which the bicycle is attached.

In all cases with reference to the attached drawings, it must be pointed out that the different figures contain numerical references to the following description of the characteristics and operation so as to enable them to be located at once, whereby -1- is the base or horizontal rectangular platform whose central area contains the lengthwise cavity or channel -2- where the continuous loop moving belt -3- is housed and on which the wheels -4- of the bicycle -5- are set along the central line -6-. The platform -1- may also have two handrails 17 for the cyclist's safety, secured to the sides of the base up to a suitable height.

At the front of the base or platform -1-, there is a vertical front panel -7- which has, in the center of its inside face, the vertical swinging arm -8-, bent at the top -9- toward the bicycle -5- and with a forked end -10- with flange-shaped connections to secure the bicycle by the frame or handlebar.

The flange-style connections have arms or hooks -11- of which at least one is articulated, securing the tube -12- of the handlebar with the tightening bolt -13- which may or may not have the bolt -14- to ensure a perfect attachment and locking the steering so that the bicycle -5- always runs along the center -6- of the moving belt -3-. The bicycle likewise remains upright so that the user can mount it in complete safety and can tilt the bicycle -5- using a system with an upward pendular movement of the vertical swivel arm -8- for which there are springs or road-springs -15- which tend to keep the bicycle vertical so that the cyclist must force the inclination in order to facilitate pedalling. In addition, the assembly has stop devices on the base to limit inclination to about 20 degrees from the vertical in either direction.

In the belief that all the parts of this apparatus for the training of cyclists and for physical exercise which is the subject of this invention have been fully described, it remains only to be said that the different parts may be manufactured in a variety of materials, sizes and shapes, and the design may also incorporate such construction variations as practice may recommend, provided that this does not alter the essential elements of which this application is the subject.

What is claimed is:

1. An apparatus for training cyclists and for physical exercise comprising a generally rectangular base platform having a lengthwise center section on a top side that includes a generally rectangular opening in which a moving belt runs, a device for securing a bicycle so that its wheels are positioned on top of said belt, at least one handrail attached to said base platform along at least one longitudinal side of said base, a front panel secured vertically to a front of said base platform, a vertical upward arm located generally at the transverse center of said base and an inward side of said front panel which vertical upward arm is adapted to connect the bicycle by its handlebar by a horizontal bar that is formed at a top of said vertical upward arm and directed inward the bicycle, and the end of said horizontal bar towards the bicycle including a fork having two branches terminating in pinchers to fit and attach the bicycle to the apparatus.

2. The apparatus for training cyclists and for physical exercise as set forth in claim 1 wherein said vertical upward arm supporting said horizontal bar holding the bicycle is attached to said base at the generally transverse mid-point of the front of said base to allow lateral movement which enables the cyclist to tip the bicycle, and two spring suspension systems maintain support of and keep the bicycle vertical.

3. The apparatus for training cyclists and for physical exercise as described in claim 2, wherein said horizontal bar is adapted to hold the bike at its frame.

4. A device for simulation of riding a bicycle comprising a base platform with a belt extending longitudinally along said base in a cavity formed on a top of said base at the transverse center of and extending longitudinally along said base platform, a vertically extending bar at a front end and transverse center of said base platform for securing the bicycle generally upright with its wheels on top of said belt, and said bar being connected to a suspension system with spring resistance that permits a user of the device to incline the bicycle from vertical, said spring resistance including coil springs with one end connected to said vertical bar and a second end connected to a vertical front panel that is attached to the front end of said base in front of said vertical bar.

5. The device as described in claim 4, wherein said vertical bar also includes a horizontal bar formed at its top and directed rearward from the front of said base toward and adapted to be attached to the bicycle.

6. The device as described in claim 5, wherein said horizontal bar has at its end nearest the bicycle a fork with two branches and each end of each branch includes a pincher with two arms that are adjustable to hold and secure a handlebar of the bicycle.

7. An apparatus for holding a bicycle in place for simulated riding comprising a base platform, a belt extending along the top longitudinal centerline of said base adapted to support wheels of the bicycle, a vertical support system attached substantially near a front end of said base and adapted to support the bicycle in a generally vertical position, and a suspension system attached to said support system with resistance permitting a user to ride the bicycle at an inclination from vertical, said vertical support system including a vertical bar forward of the bike and attached to said base for pendular movement, said vertical bar also including a horizontal bar at its top that extends rearwardly toward and adapted to secure the bicycle, and said vertical bar being positioned near the longitudinal centerline of said base.

8. The device as described in claim 7, wherein said suspension system includes springs attached to said vertical support system that provide a resistance to inclining the bicycle from vertical.

9. The device as described in claim 7, wherein said suspension system includes springs connected to said vertical bar and a vertical front panel that is secured forward of said vertical bar to the front end of said base platform, and said springs are adapted to provide resistance against inclination of the bicycle.

10. The device as described in claim 7, wherein said horizontal bar includes a fork with two branches on its end nearest the bicycle adapted to secure the front of the bike directed toward the front of said base, and said branches each have an end that clasps and secures to opposite transverse portions of a handlebar of the bike.

11. An apparatus for holding a bicycle in place for simulated riding comprising a base platform, a belt extending along the top longitudinal centerline of said base adapted to support wheels of the bicycle, a vertical support system attached substantially near a front end of said base and adapted to support the bicycle in a generally vertical position, and a suspension system attached to said support system with resistance permitting a user to ride the bicycle at an inclination from vertical, said suspension system including springs connected to said vertical bar and a vertical front panel that is secured forward of said vertical bar to the front end of said base platform, and said springs are adapted to provide resistance against inclination of the bicycle.

* * * * *